US006938440B2

(12) United States Patent
Smith

(10) Patent No.: US 6,938,440 B2
(45) Date of Patent: Sep. 6, 2005

(54) JEWELRY DISTRIBUTION AND DISPLAY COMBINATION AND KIT

(75) Inventor: Michele Smith, Beverly Hills, CA (US)

(73) Assignee: Michele Smith Designs, Inc., Beverly Hills, CA (US)

( * ) Notice: Subject to any disclaimer, the term of this patent is extended or adjusted under 35 U.S.C. 154(b) by 354 days.

(21) Appl. No.: 10/285,718

(22) Filed: Nov. 1, 2002

(65) Prior Publication Data

US 2004/0244418 A1 Dec. 9, 2004

(51) Int. Cl.[7] ..... A44C 13/00; A41B 9/04

(52) U.S. Cl. ..... 63/1.18; 63/1.11; 63/3; 63/3.1

(58) Field of Search ..... 63/1.11, 3, 3.1, 63/1.14–1.18, 4, 33, 38, 8; 2/67, 78.1, 78.3, 311, 78.4, 323, 400–409; 450/94, 100, 106; 24/298–300, 302

(56) References Cited

U.S. PATENT DOCUMENTS

| | | | | |
|---|---|---|---|---|
| 210,816 A | * | 12/1878 | Stevens | 63/3.1 |
| 1,441,924 A | * | 1/1923 | Hartmann | 63/38 |
| 1,457,350 A | * | 6/1923 | Damiano | 63/3.2 |
| 1,556,106 A | * | 10/1925 | Hamilton | 63/1.11 |
| 2,228,686 A | | 1/1941 | Bezault | |
| 5,031,420 A | * | 7/1991 | Song | 63/21 |
| 5,699,901 A | | 12/1997 | Cohen | |
| 5,713,080 A | | 2/1998 | Tate | |
| 5,763,025 A | | 6/1998 | Jones | |
| 5,873,151 A | | 2/1999 | Sood | |
| 5,921,110 A | | 7/1999 | Middendorff | |
| 5,967,326 A | | 10/1999 | Tessler et al. | |
| 6,012,203 A | | 1/2000 | Baron Pearson | |
| 6,026,515 A | | 2/2000 | Nielson et al. | |
| 6,027,213 A | * | 2/2000 | Ignatowski | 63/3 |
| 6,067,663 A | | 5/2000 | Fernandez | |

(Continued)

FOREIGN PATENT DOCUMENTS

| | | | |
|---|---|---|---|
| FR | 2 841 440 | * | 1/2004 |
| GB | 2 392 820 A | * | 3/2004 |
| WO | WO 98/42293 | * | 10/1998 |

OTHER PUBLICATIONS

Dainties.com Website, dated Oct. 17, 2001.*

Admcity fashion; Bra and G–string set featuring jeweled straps, product No. 357 ex 802; http://fashion.admcity.com; Oct. 23, 2002.

(Continued)

*Primary Examiner*—Robert J. Sandy
*Assistant Examiner*—Ruth C. Rodriguez
(74) *Attorney, Agent, or Firm*—Hankin Patent Law; Marc E. Hankin

(57) ABSTRACT

An apparatus for the distribution and display of jewelry includes a plurality of precious or semi-precious gems coupled together in a "T" shape with at least one horizontalbar and one downbar, the horizontalbar having clasps at both ends and the downnbar having a clasp at one end. The apparatus further includes a clothing article requiring at least one strap for support with a semi-permnanently attached loops being configured to receive a respective attachment device. The apparatus further includes a flexible strand or chain having attached loops at both ends, each of the loops being configured to receive a respective attachment device. The jewelry article is designed in order to be distributed and displayed as an integral structural member of the clothing and jewelry combination or the flexible strand or chain and jewelry combination.

27 Claims, 9 Drawing Sheets

U.S. PATENT DOCUMENTS

| | | | | |
|---|---|---|---|---|
| 6,070,434 | A | 6/2000 | Traver | |
| 6,098,202 | A | 8/2000 | Peck | |
| 6,202,443 | B1 | 3/2001 | Grosser-Samuels | |
| 6,293,128 | B1 * | 9/2001 | Leufray-Simms | 63/23 |
| 6,367,088 | B1 | 4/2002 | Bergemann | |
| 6,401,488 | B1 * | 6/2002 | Cousin et al. | 63/3 |
| 6,427,487 | B1 | 8/2002 | Morgan | |
| 6,449,818 | B1 | 9/2002 | Fildan et al. | |
| 6,450,595 | B1 | 9/2002 | Simon | |
| 6,604,381 | B2 * | 8/2003 | Haber | 63/23 |
| D484,671 | S * | 1/2004 | Swan | D2/712 |
| 6,715,910 | B2 * | 4/2004 | Robey | 362/559 |
| 6,785,910 | B2 * | 9/2004 | Zic et al. | 2/67 |
| 2002/0020190 | A1 | 2/2002 | Clark et al. | |
| 2002/0023289 | A1 | 2/2002 | Arias et al. | |
| 2002/0078707 | A1 * | 6/2002 | Walker et al. | 63/3.2 |
| 2002/0108688 | A1 | 8/2002 | Reiss | |
| 2002/0116947 | A1 | 8/2002 | Mount | |
| 2002/0148251 | A1 | 10/2002 | Plumly | |

OTHER PUBLICATIONS

Victoria's Secret; jewel strap V–string, #151–165; http://www.victoriassecret.com; Oct. 23, 2002.

biatta.com; crystalline, #B0149, #B2149, #B4149; http://www.biatta.com; Oct. 23, 2002.

Trashy Lingerie; Jewel Back Thong; http://www.trashy.com; Oct. 23, 2002.

Trashy Lingerie; Nicole Beaded Bikini; http://www.trashy-.com; Dec. 30, 2002.

World of Lingerie; Christmas 2002, #CIGO–08.002.5; http://www.worldoflingerie.nl; Dec. 30, 2002.

* cited by examiner

JEWELRY DISTRIBUTION AND DISPLAY COMBINATION AND KIT

FIELD OF INVENTION

The field of this invention concerns devices and methods used in the distribution and display of jewelry and similar articles.

BACKGROUND OF THE INVENTION

Jewelry, including that of precious and semi-precious gems, is typically distributed and displayed in boxes, envelopes, cards and other media by the jeweler or retailer. Distribution of jewelry, when purchased with other items, is often separated from the other items either entirely or separated in such a manner where the items are functionally two independent items and not structurally dependent on one another. The jewelry may match another item intended to be purchased in tandem with the jewelry, for example a broach and a dress, but remains at least removable and separate or at most, giving the appearance of an afterthought of the original clothing item design and intention. In the example given, a dress is still completely functional without the matching broach.

Once the jewelry is purchased by the customer, the medium of distribution, whether a box, envelope, card, or similar medium of distribution and display, generally are not used in the future display of that jewelry, especially while the jewelry piece is being worn by the customer. Frequently, these methods of retail distribution and display of the jewelry are discarded and therefore a waste in regards to that portion of the jewelry purchase by the customer; the more extravagant or expensive the method of retail distribution and display, the larger the pecuniary waist of the customer. Such waist may further be experienced by the retailer due to increased mark-up percentage by the distributor(s), which may incorporate increased net cost to the retailer.

Additionally, jewelry may be fashioned in shapes that embrace and often circumscribe the contours of the human shape, as a necklace, bracelet, anklet, waist chain ("belly chain"), or similar form. Jewelry may also be fashioned in a form that allows it to be attached to clothing, such as a broach or tie tack, as mentioned above. However, jewelry is not currently distributed and displayed as an integral part of garments requiring at least one strap for support and garment integrity.

Recently, it has become fashionable to wear one's undergarments in such a manner that the dorsal portion of the undergarment (e.g., thong, G-string, or the like) is permitted to be seen above the waistline of the dorsal portion of a pair of trousers, shorts, skirt, dress, kilt, or similar article of clothing. The general intent of this method of display of undergarments, as a fashion statement, is to be seen by others as well as to be current in the world of fashion.

An attempt to combine fine jewelry, consisting, for example, of precious and semiprecious gems, on the dorsal portion of the thong seen above the waistline may be uncomfortable for the wearer. Additionally, the risk of loss of fine jewelry in an attempt to display jewelry in such a manner should greatly increase the possibility of loss of that jewelry worn because this manner of display diverges from intended jewelry design and use.

The wearer of such a piece of jewelry attached to an undergarment (e.g., thong, G-string, or the like) may also risk damage to porous or semi-porous gems or stones, such as is pearls or opals, with constant exposure to heat and moisture from bodily fluids.

In regard to jewelry pieces that attach to clothing, many jewelry articles attach and detach by various mechanisms. For example, U.S. Pat. No. 6,098,202 describes a belt loop jewelry article that engages and releases belt loops with clasps. In another example, U.S. Pat. No. 6,012,203 describes an interchangeable snap-on adornment for fashion accessories that uses a stud and socket combination that engages and releases clothing. In still another example, U.S. Pat. No. 6,070,434 describes an ornamental neckpiece chain or cord which spans the neck of a collared shirt by connecting to the button and buttonhole when the shirt is unbuttoned. Once any of these jewelry accessories are removed, however, the item of clothing is structurally unaltered and the integrity of the clothing article remains in substantially the same state as when the clothing article was first made (small holes may be present after using the snap-on adornment).

In regard to clothing and jewelry combinations where the jewelry piece is necessary and an integral part of the clothing article structure, not limited to an accessory only, existing examples are known. For example, U.S. Pat. No. 6,449,818 includes a garment link which serves may serve as a necessary structural member of the clothing article by linking two straps, but is not intended to be easily removed from the clothing article. In another example, U.S. Pat. No. 6,067,663 describes a feminine garment with a sexually stimulating effect due to a string of beads which serves as the sole support of the clothing article in the pubis and rectal areas, again where the beads are not removable without damaging the clothing article.

U.S. Patent Application US 2002/0108688 A1 describes a handbag and case with a multi-purpose bejeweled strap which is easily removable and may also be worn as a necklace or bracelet by engaging the opposing ends of the removable strap. However, the strap may be easily substituted for many other removable purse straps which can engage and release the clasps or eyes of the handbag. Even the invention disclosed in 1941 in U.S. Pat. No. 2,228,686, which describes an easily removable bejeweled chain, may potentially engage and release the handbag of US 2002/0108688. The jewelry strap of this handbag does not render the handbag unusable, however, as many people carry a handbag in their hands, especially if the handbag also has a handle. Additionally, the object of the removable bejeweled strap is a point of storage, where one is able to wear the strap as an accessory in the event that the strap is removed instead of storing it in the handbag. This is quite different from the invention disclosed herein.

SUMMARY OF INVENTION

The design of this jewelry and jewelry distribution and display combination is intended to overcome the aforementioned shortcomings. It is therefore an object of this invention to serve as a distribution method of fine jewelry, as precious and semi-precious gems, as an interchangeable and a structurally necessary member of both clothing and human form-fitting jewelry.

It is an object of this invention to display jewelry in the store for purchase and also while on the wearer in a manner that it can be seen by people other than the wearer of the jewelry. The strategic placement of the jewelry permits viewing by the public, despite the intimate nature of the display piece, namely, an undergarment or other garment, normally shielded from public view.

The jewelry itself is designed to be detached easily from the display piece and can be converted from a structural member of the garment to a more conventional piece of jewelry, for instance a necklace, bracelet, anklet, waist chain ("belly chain"), or similar form by the addition of certain elements including a chain extension and jewelry baubles. Thus, the garment serves as a method of distributing the jewelry to the wearer in an innovative, novel, and useful manner and is combined with the distribution of a kit to convert the garment-support to purely ornamental fine jewelry.

A further object of this invention is the display of jewelry as a structurally necessary part of a garment in order that people other than the wearer of the jewelry may view the jewelry as both a required support strap of the garment and as a piece of jewelry fitting the shape of the human form. Therefore, removal of the jewelry piece would render the garment nonfunctional when removed. The design of the jewelry piece is designed to withstand the various physical stresses (as shear stress, torque or torsion) as would a necessary support member of a garment.

When the garment is a thong, G-string, or other form of undergarment, the jewelry may be viewed as the dorsal portion of the undergarment showing above the waistline of a pair of trousers, shorts, skirt, dress, kilt, or similar article of clothing.

Similarly, the undergarment could be a brassiere in which the jewelry supports and/or connects the two halves (breast cups) either in the front or in the back of the bra. Further, the garment could be any garment designed with support straps, for example a gown, dress, skirt, bikini, lingerie, negligee or garter.

In all cases in which the jewelry is displayed and distributed in combination with a garment or article of clothing, the jewelry is detachable so that the garment may be washed in a machine and need not necessarily be hand-washed, thus saving the wearer a lot of labor and time. Moreover, while the garment piece is being cleaned, the jewelry still may be worn by the wearer through use of the conversion kit as more traditional looking jewelry.

A further object of this invention is the display of jewelry as mentioned above such that any combination of the display methods mentioned (necklace, bracelet, anklet, waist chain ("belly chain"), or related methods of display) may be worn in such a manner as to match one other with either similar, contrasting, complementary, or even identical jewelry pieces (allowing for natural variation in any natural precious or semi-precious gem) with a jewelry piece attached to a garment or undergarment, for example a thong or G-string. Thus the wearer can coordinate one's fashion accessories in a manner never before possible.

A further object of this invention is the display of jewelry as an integral portion of a garment, including a thong undergarment, which preserves the integrity of porous and semi-porous gems by positioning the gems away from areas of heat and moisture of the human body. The invention is designed to be worn in such a manner as to protect the jewelry from said heat and moisture as well as away from dirt, odors, and other potentially unpleasantness, while still serving its function as a structural component of the garment.

DETAILED DESCRIPTION OF PREFERRED EMBODIMENTS

Figure 1:
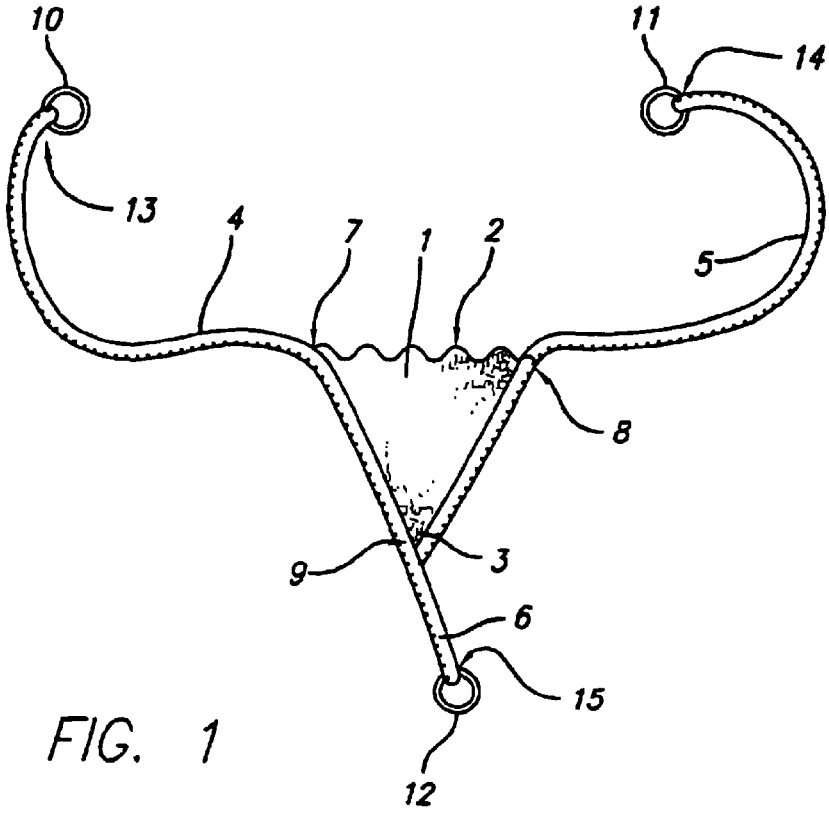
FIG. 1 is a view of the clothing piece.

As shown in FIG. 1, the clothing article comprises a frontpiece 1, preferably triangular in shape, but may be another shape, with the top of the frontpiece 2 wider than the bottom of the frontpiece 3, with two opposing sidebar members 4 and 5 and one downbar member 6, planarly arranged. The sidebar and downbar members are attached to the frontpiece member at a first end 7, 8 and 9 and each have a semi-permanently attached loop 10, 11 and 12 at a second end 13, 14 and 15. The downbar member attachment to the frontpiece is centered. All or part of the clothing piece may comprise fabric, animal hide, leather, metal, rubber, plastic or carbon fiber.

Figure 2:
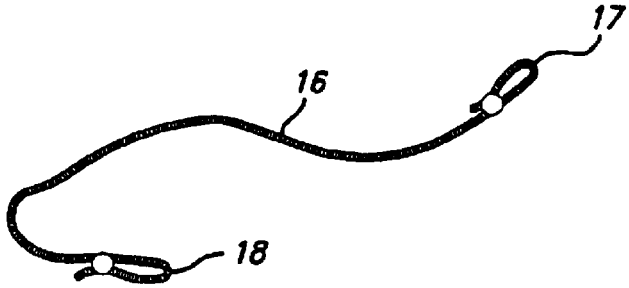
FIG. 2 is a view of the flexible strand.

As shown in FIG. 2, the flexible strand comprises a flexible strand or similar article 16, preferably steel cable, chain or similar material in strength, having attached loops 17 and 18 at each end of said strand, each of said loops being configured to receive a respective attachment device, here preferably jewelry lobster clasps. All or part of the flexible strand may comprise fabric, animal hide, leather, metal, rubber, plastic, carbon fiber, beads, trinkets, semi-precious and precious gems.

Figure 3:
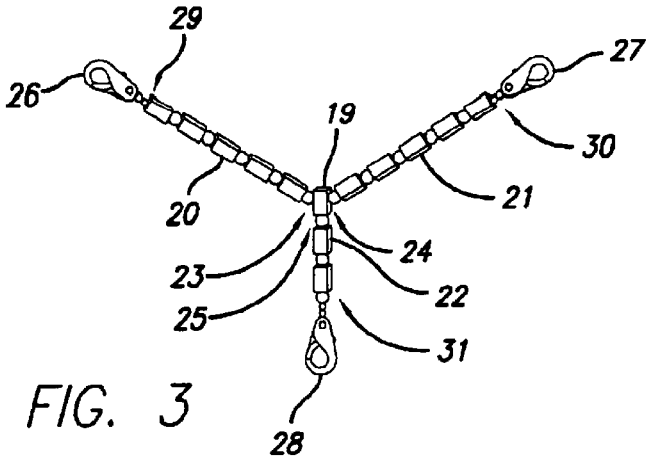
FIG. 3 is a view of a first embodiment of the jewelry piece, showing a central member, two sidebars and a downbar.
Figure 4:
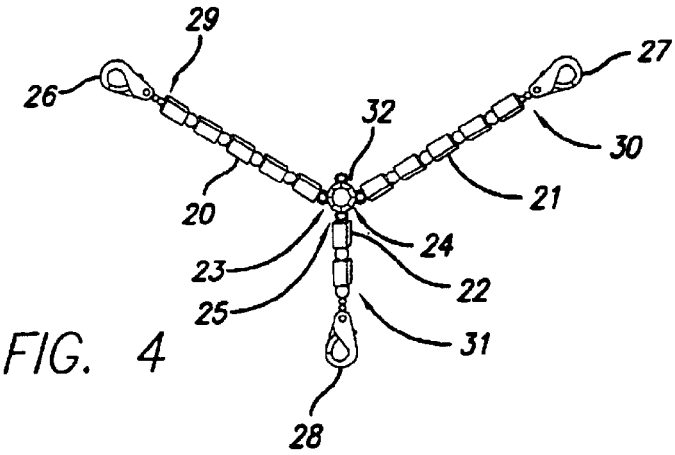
FIG. 4 is a view of a second embodiment of the jewelry piece, showing a visibly distinguishable central member, two sidebars and a downbar.
Figure 5:
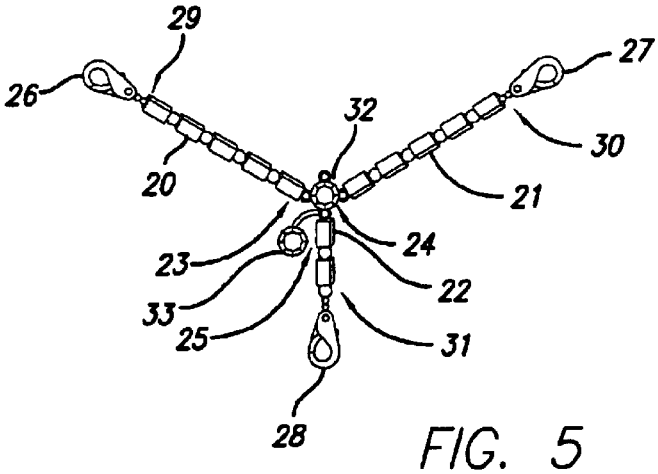
FIG. 5 is a view of a third embodiment of the jewelry piece, showing a visibly distinguishable central member with attachments thereto, two sidebars and a downbar.

As shown in FIGS. 3–5, the jewelry piece comprising a plurality of jewels, beads, stones and trinkets with a center member of a plurality of jewels, beads, stones and trinkets 19 connected to two opposing sidebar members of a plurality of jewels, beads, stones and trinkets of 20 and 21 and one downbar member of a plurality of jewels, beads, stones and trinkets 22, planarly arranged with a first end 23, 24 and 25 connecting the central member to each bar. The first end of the sidebars and downbar may include loops 59. The sidebar and downbar members each have a jewelry clasp 26, 27 and 28 at the second end 29, 30 and 31, preferably a "lobster" clasp, for engaging and releasing attachments, preferably loops, or separate decorative elements, including beads, trinkets, semi-precious and precious stones. The jewelry piece downbar member and the clothing piece downbar member are designed to connect above or about the tailbone region of the wearer. An alternative embodiment, as shown in FIG. 4 illustrates the jewelry piece bejeweled central member comprising a visibly distinguishable central member 32. A further alternative embodiment as shown in FIG. 5 illustrates the jewelry piece bejeweled central member comprising a visibly distinguishable central member 32 and an engaged separate decorative element 33. The separate decorative elements may include beads, trinkets, semi-precious and precious gemstones.

Figure 6:
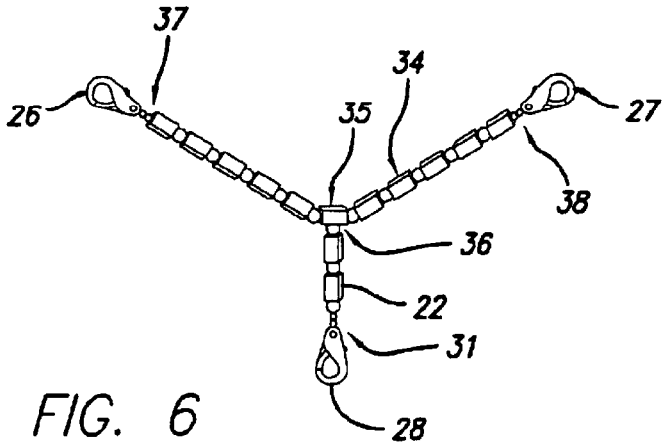
FIG. 6 is a view of a fourth embodiment of the jewelry piece, showing a flexible strand and a downbar.
Figure 7:
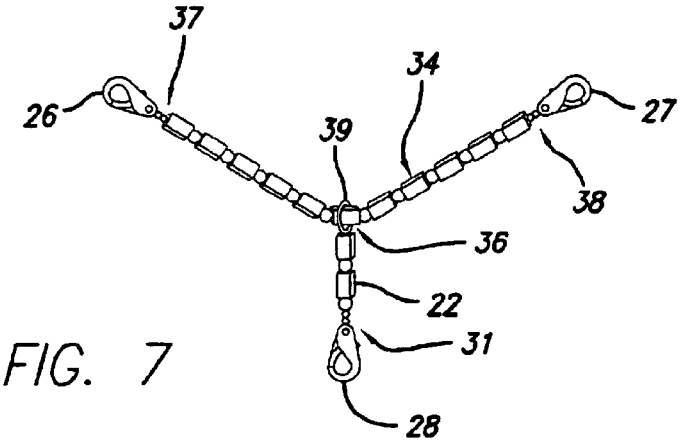
FIG. 7 is a view of a fifth embodiment of the jewelry piece, showing a flexible strand and a downbar and a visibly distinguishable attachment device.
Figure 8:
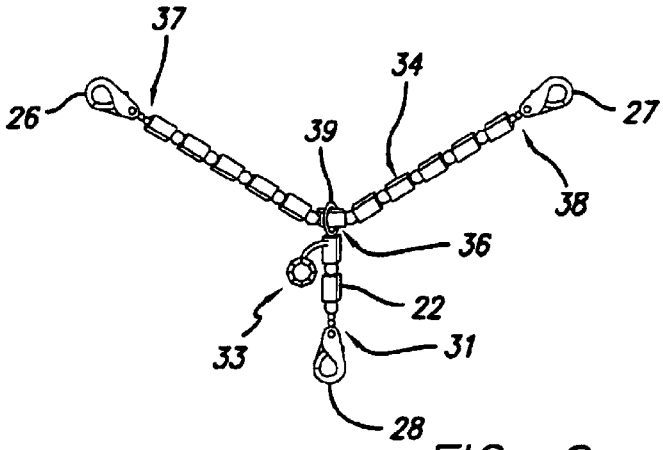
FIG. 8 is a view of a sixth embodiment of the jewelry piece, showing a flexible strand and a downbar and a visibly distinguishable attachment device and attachments thereto.

As shown in FIGS. 6–8, the jewelry piece comprising a plurality of jewels, beads, stones and trinkets with a bejeweled flexible strand of a plurality of jewels, beads, stones and trinkets 34 and a bejeweled downbar member of a plurality of jewels, beads, stones and trinkets 22, connected to the flexible bejeweled strand 35 at the first end 36. The flexible strand has jewelry clasps 26, 27 and 28 at the free ends 37 and 38 and the downbar member has a jewelry clasp at a second end 31, preferably "lobster" clasps, for engaging and releasing attachments, preferably loops. An alternative embodiment, as shown in FIG. 7, illustrates the bejeweled downbar member engaging the bejeweled flexible strand with a visibly distinguishable attachment device 39, preferably at least one closed loop, or separate decorative elements, including beads, trinkets, semi-precious and precious stones. The jewelry piece downbar member and the clothing piece downbar member are designed to connect above or about the tailbone region of the wearer. A further embodiment, as shown in FIG. 8, illustrates a separate decorative element 33 engaging the visibly distinguishable attachment device 39.

Figure 9:
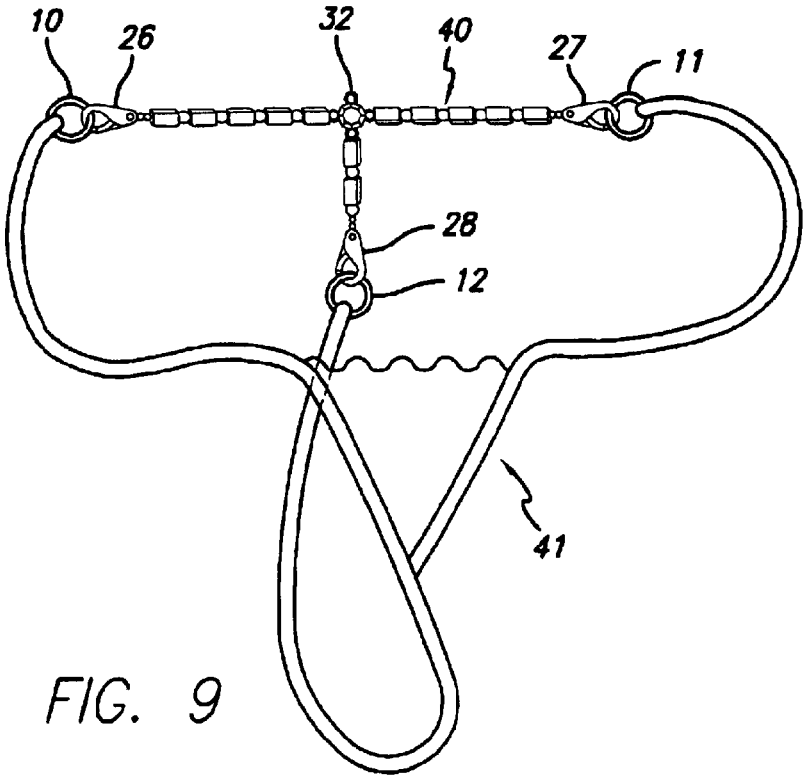
FIG. 9 is a view of the first embodiment of the jewelry piece, comprising a visibly distinguishable central member, two sidebars and a downbar, and the clothing piece to form a complete clothing undergarment and jewelry display.
Figure 10:
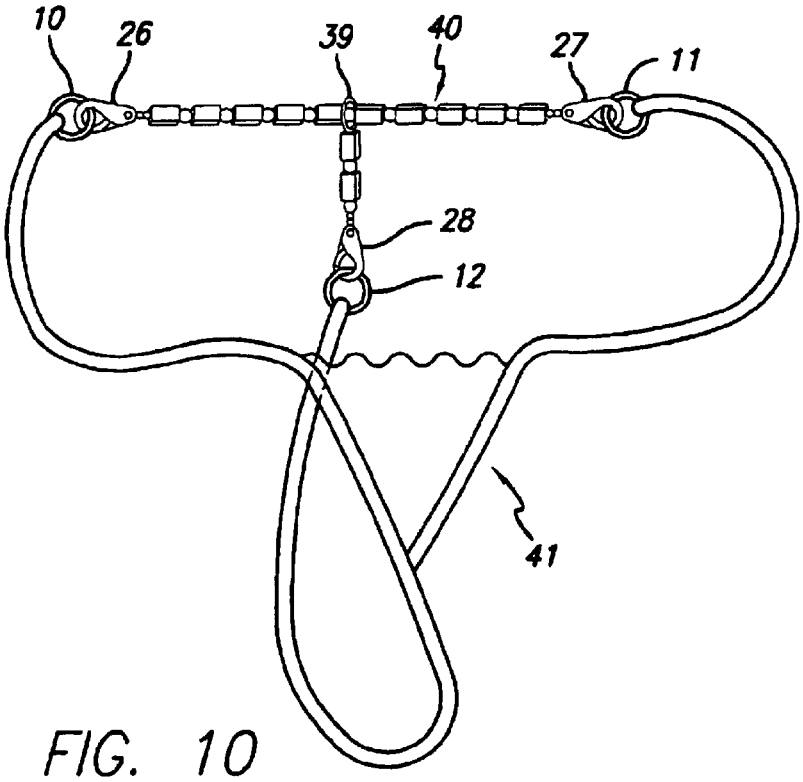
FIG. 10 is a view of the second embodiment of the jewelry piece, comprising a flexible strand and downbar with a visibly distinguishable attachment device, and the clothing piece to form a complete clothing undergarment and jewelry display.

As shown in FIGS. 9 and 10, the jewelry piece 40 and the clothing piece 41 are connected together with the clasps of the jewelry piece 26, 27 and 28 engaging the loops of the clothing piece 10, 11 and 12 to form a complete clothing undergarment and jewelry display. As shown in FIG. 9, the jewelry piece bejeweled central member comprises a visibly distinguishable central member 32. In another embodiment, as shown in FIG. 10, the bejeweled downbar member engages the bejeweled flexible strand with a visibly distinguishable attachment device 39, here a closed loop. The positioning of the jewelry piece precious and semi-precious gems are situated such that the gems are above the tailbone as well above the waistline of various articles of clothing.

Figure 11:
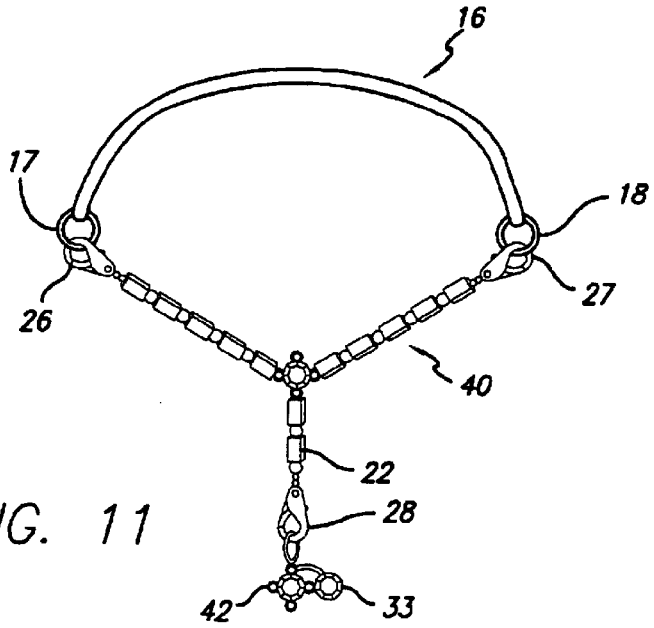
FIG. 11 is a view of the first embodiment of the jewelry piece, comprising a visibly distinguishable central member, two sidebars and a downbar engaging attachments, and the flexible strand piece to form a complete necklace, bracelet, anklet, waist chain ("belly chain"), or similar form to embrace and circumscribe a portion of human shape for jewelry display.
Figure 12:
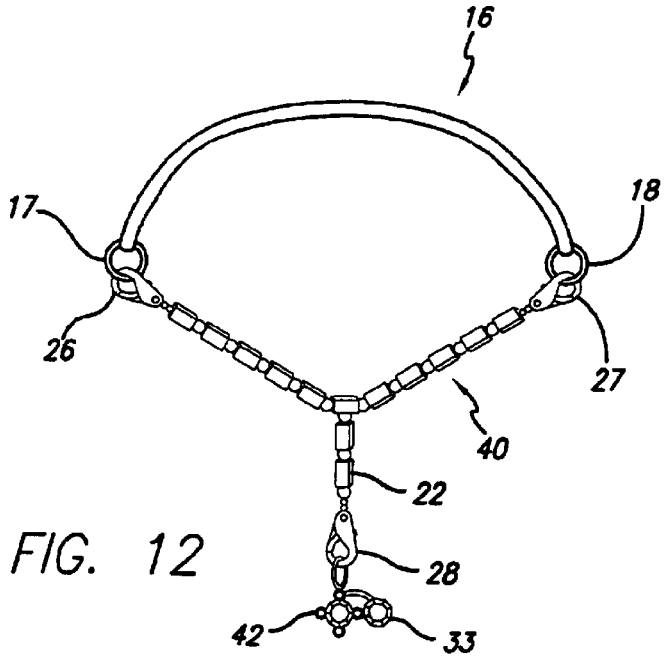
FIG. 12 is a view of the second embodiment of the jewelry piece, comprising a flexible strand and downbar with a visibly distinguishable attachment device and engaged attachments, and the flexible stand forming a complete necklace, bracelet, or similar item to embrace and circumscribe a portion of human shape for jewelry display.

As shown in FIGS. 11 and 12, the jewelry piece 40 and the flexible strand 16 are connected together with the clasps of the jewelry piece 26, 27 and 28 engaging the loops 17 and 18 of the flexible strand to form a complete necklace, bracelet, anklet, waist chain ("belly chain"), or similar form to embrace and circumscribe a portion of human shape for jewelry display. In FIGS. 11 and 12, the jewelry piece and flexible strand, here a steel cable, are assembled to form a necklace to display the jewelry of precious and semi-precious stones. The unengaged downbar member 22 of the jewelry article is suspended at the ventrally oriented lowest point of the necklace with separate decorative elements 33 and 42 engaged by the clasp of the jewelry piece downbar.

Figure 13A:
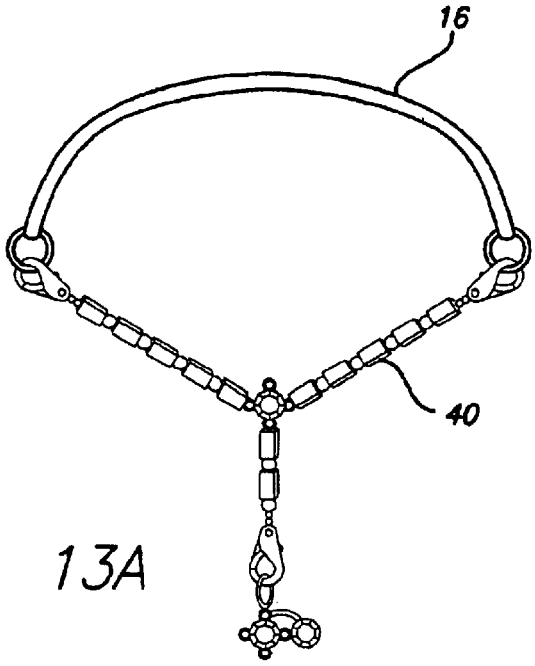
FIGS. 13A and 13B are a view of the flexible strand piece and the clothing piece used with identical jewelry pieces to compose a matching undergarment and necklace jewelry display.
Figure 13B:
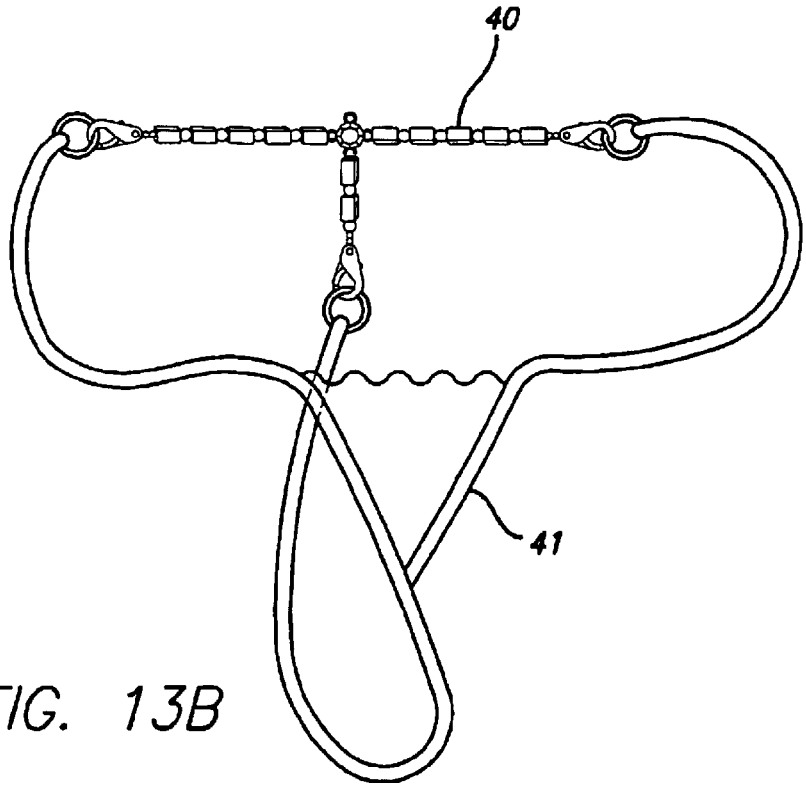

As shown in FIG. 13, the combination of FIGS. 9 and 11 show a matching jewelry display of a jewelry piece 40 and clothing piece 41, here an undergarment, combination together with a jewelry piece 40 and flexible strand 16 necklace combination.

Figure 14A:
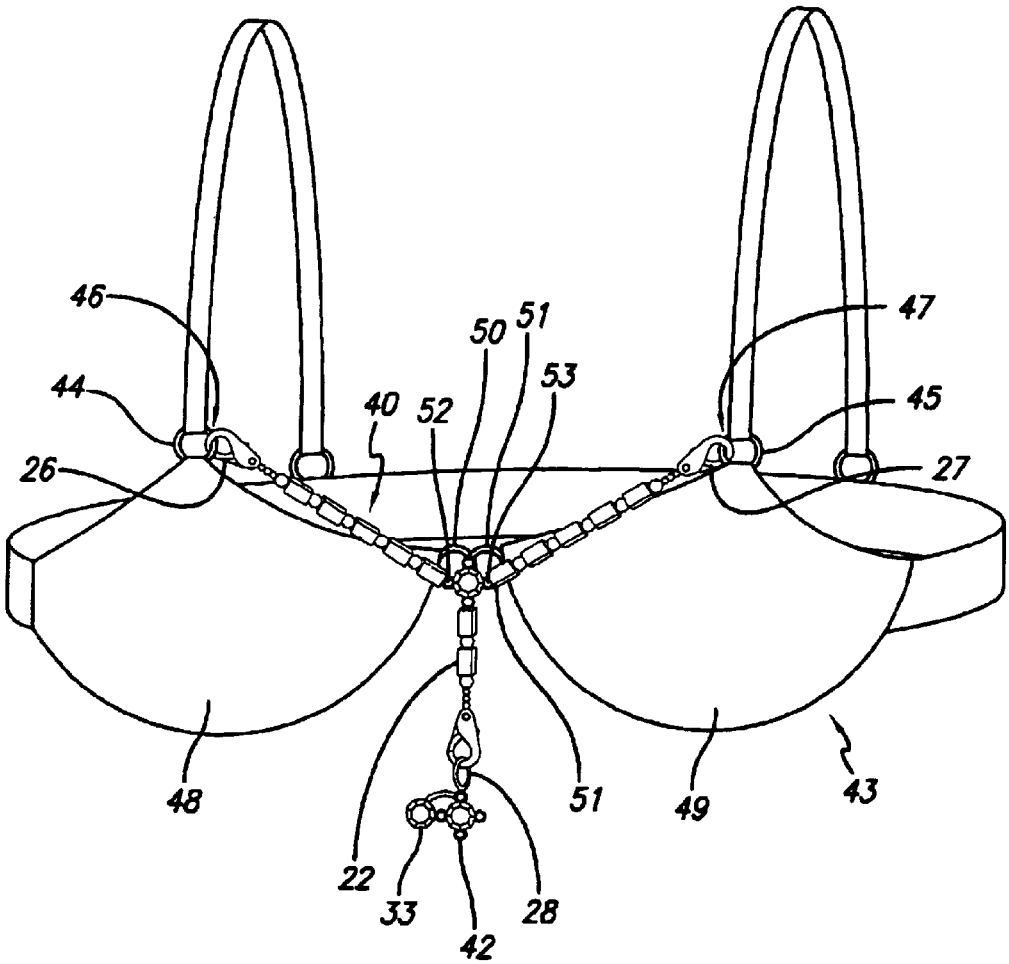
FIGS. 14A and 14B are a view of the first embodiment of the jewelry piece, comprising a visibly distinguishable central member, two sidebars and a downbar, and a clothing piece to form a complete brazier and jewelry display.
Figure 14B:
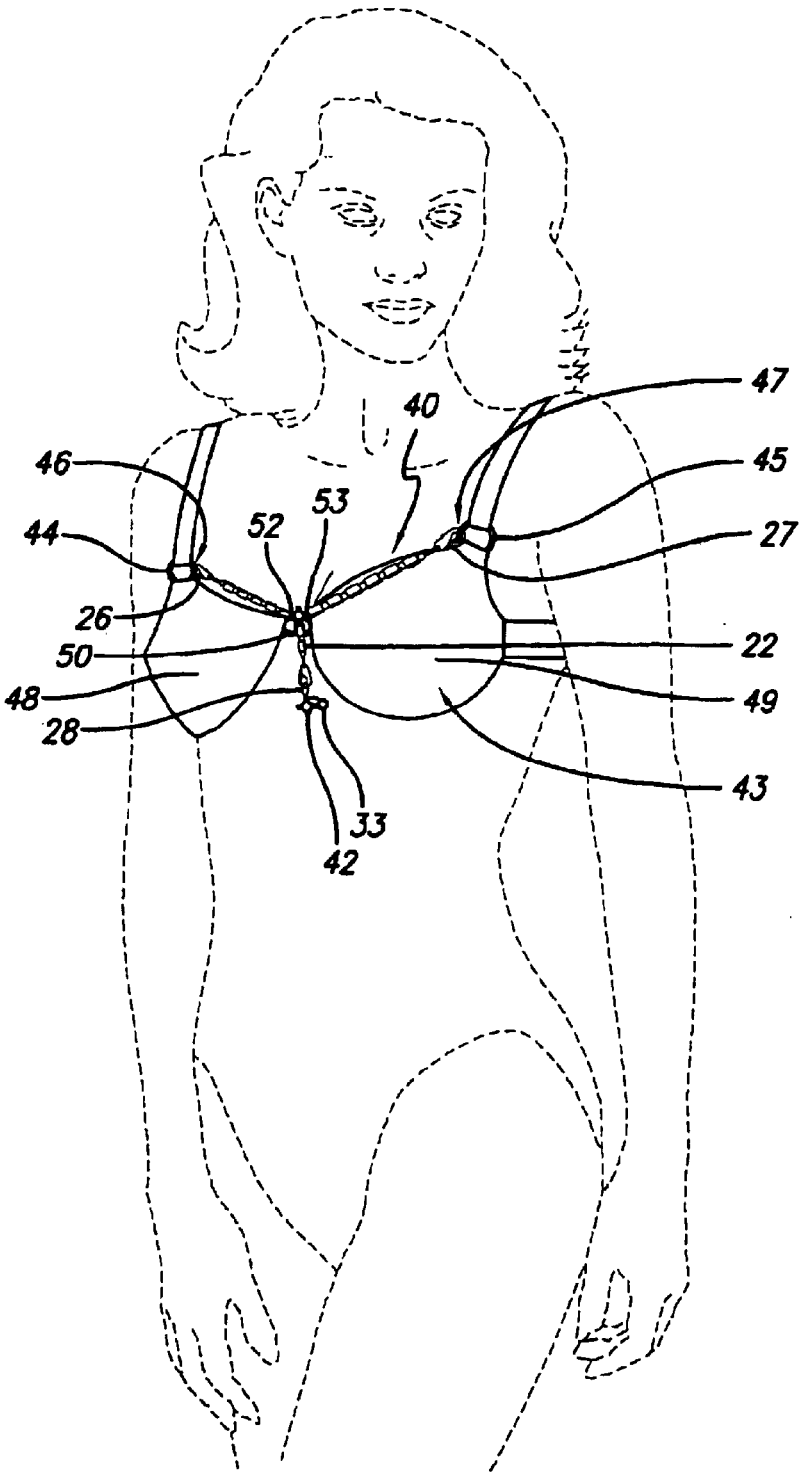

As shown in FIGS. 14A and 14B, the jewelry piece 40 and clothing piece 43, here a brassiere, are connected together with the clasps of the jewelry piece 26 and 27 engaging the loops of the brazier 44 and 45 to form the connecting ventral points of the two cups of the brazier 46 and 47 and the ventral attachment of the ventral and dorsal anterior straps for a jewelry display. Each cup of the brazier 48 and 49 includes a plurality of loops 44, 45, 50 and 51, at least one loop at the top of the cup 44 and 45 and at least one loop at the point of the cup closest to the vertical axis of the human breastbone 50 and 51, configured to receive attachment devices 52 and 53, preferably lobster clasps. The clasps of the jewelry piece and clothing piece, here a brazier, in FIGS. 14A and 14B are assembled to form a brazier to display the jewelry of precious and semi-precious stones. The downbar member of the jewelry piece 22 is suspended at the ventrally oriented lowest posterior point of the brazier with separate decorative elements 33 and 42 engaged by the clasp of the jewelry piece downbar 28.

Figure 15:
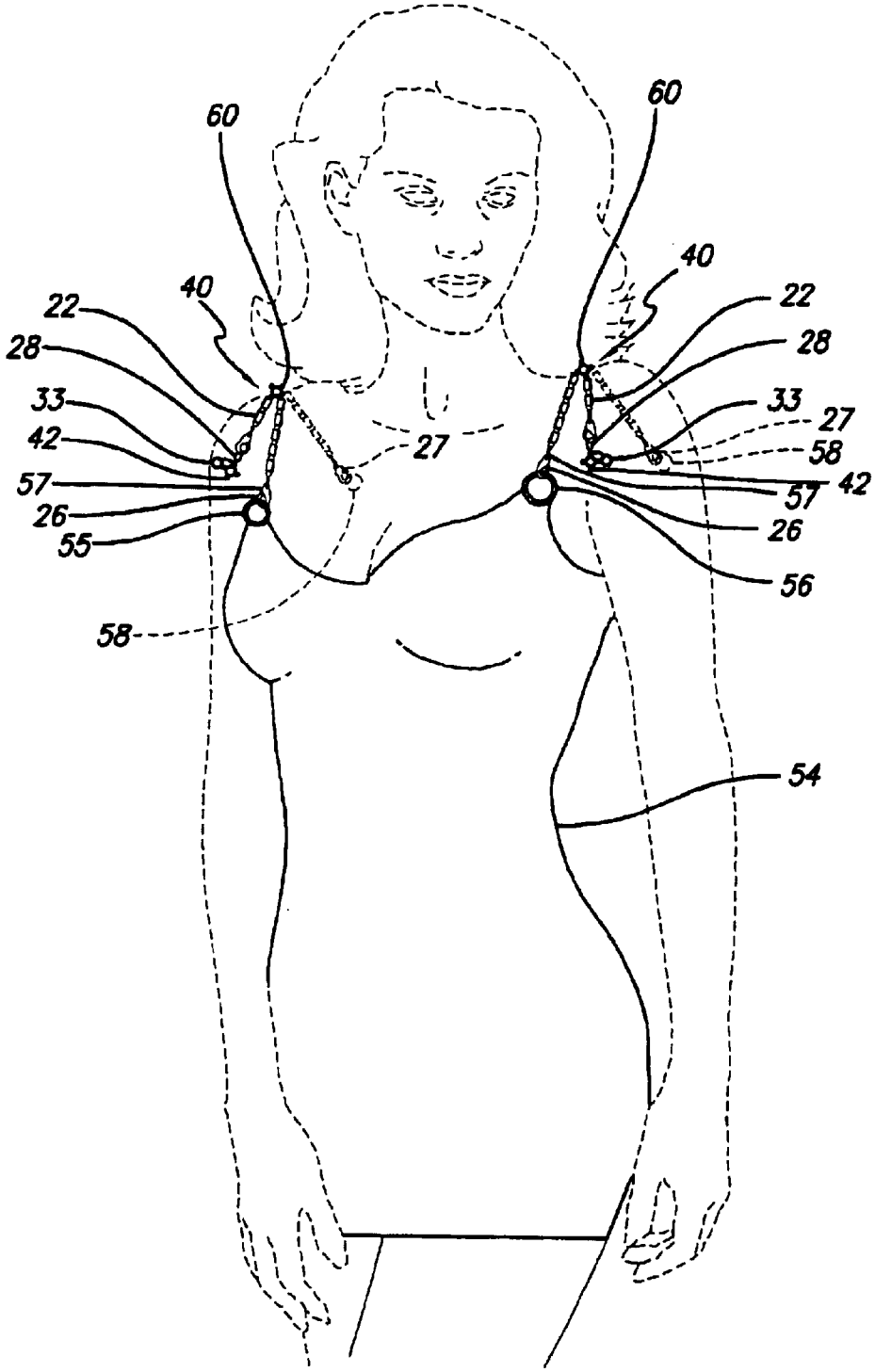
FIG. 15 is a view of the first embodiment of two jewelry pieces, comprising a visibly distinguishable central member, two sidebars and a downbar, and a clothing piece to form a complete clothing cocktail dress and jewelry display.

As shown in FIG. 15, two jewelry pieces 40 and clothing piece 54, here a cocktail dress, are connected together with the clasps of the jewelry piece 26 and 27 engaging the loops of the cocktail dress 55 and 56 oriented above the breasts ventrally at a first end 57 and second end 58 positioned dorsally about the wearer of the cocktail dress, preferably about the shoulder blades dorsally at a second end, to form the ventral to dorsal anterior straps for an over the shoulder jewelry display of precious and semiprecious stones. The downbar member of the jewelry piece 22 is suspended from the highest anterior point of the strap 60 with separate decorative elements 33 and 42 engaged by the clasp of the jewelry piece downbar 28.

Referring now to FIG. 5, a top view of the valve housing unit 1, is shown, which illustrates one possible embodiment of the retainer 12, the top of the valve piston 11, which is in position against the underside of the retainer 12, and the openings 16, in the retainer, which allow water to pass during the normal operation of the valve housing unit 1.

Referring now to FIG. 6, a top view of a possible alternate embodiment of the retainer is illustrated 21.

Referring now to FIG. 7, a top view of a possible alternate embodiment of the retainer is illustrated 22.

Referring now to FIG. 8, a top view of a possible alternate embodiment of the retainer is illustrated 23.

Referring now to FIG. 9, a top view of a possible alternate embodiment of the retainer is illustrated 24. Referring now to FIG. 10, a top view of a possible alternate embodiment of the retainer is illustrated 25.

Referring now to FIG. 11, a top view of a possible alternate embodiment of the retainer is illustrated 26.

Referring now to FIG. 12, a top view of a possible alternate embodiment of the retainer is illustrated 27.

Although the preferred embodiments of the invention have been described and illustrated above, it should be understood that various modifications and rearrangements of the parts may be accomplished without departing from the scope of the invention as disclosed and claimed herein.

For example, the valve housing unit could be manufactured using various means; it could be cast as a single piece, or to facilitate the manufacture of the device, it could be made from two or more pieces which are assembled then joined by gluing, welding, or some other permanent means.

The valve and retainer could also be manufactured in alternate configurations while still remaining within the scope of the invention claimed and disclosed. For example, there could be a flapper type which is held open by a retainer which protrudes from the frangible zone to hold the valve open. The valve could also consist of a piece of flexible tubing with the frangible zone acting as the retainer, such that when the frangible zone is intact, the tubing within it is maintained in a straight and open position, but when the frangible zone is broken, the tubing returns to its original cast bent position acting to shut off the supply of water.

I claim:

1. An apparatus for the distribution and display of jewelry comprising in combination:

a. a generally planar clothing piece of a flexible textile or similar material with a frontpiece member with a top and bottom, said top wider than said bottom, with attached flexible textile or similar material first and second sidebar members, each sidebar member having first and second ends, said first and second sidebar members each attached at said first end to said frontpiece member, said attachment sites of first end configured so that the first and second sidebar members oppose each other from opposite sides of said top of said frontpiece member, said first and second sidebar members each with a semi-permnanently attached loop of similar passive docking member at said second end, and an attached flexible textile or similar material downbar member with first and second ends, said first end attached and centered at the bottom of said frontpiece member, with a semi-permanently attached loop of similar passive docking member at said second end of said downbar member, each of said semi-permanently attached loops being configured to receive a respective attachment device;

c. a jewelry piece of a plurality of precious or semi-precious gems as well as beads and trinkets with a central member with attachment points at first, second and third points, said first and second attachment points configured to oppose each other on said central member, and said first and second attachment points of said central member connected to a plurality of opposing flexible sidebar elements, each said sidebar element having first and second ends, said first end attached to said central member at either the first or second attachment point and said second end having an attachment device and one flexible downbar element with first and second ends, said downbar element attached to the central member at said first end in a generally perpendicular fashion to said sidebar elements, and said downbar element having an attachment device at said second end wherein all said attachment device of jewelry piece at the second ends are designed in order to engage and release loops or similar passive docking members a second ends of said clothing piece or of said flexible strand to form a wearable clothing piece or necklace, bracelet, anklet, waist chain, or similar form to embrace and circumscribe a portion of human shape.

2. The apparatus for the distribution and display of jewelry of claim 1 wherein said jewelry piece comprises a visibly distinguishable central member which connects said sidebar elements and downbar element.

3. The apparatus for the distribution and display of jewelry of claim 2 wherein the central member comprises a central member that incorporates decorative elements visibly distinguishable from said sidebars and downbar elements.

4. The apparatus for the distribution and display of jewelry of claim 2 wherein the central member comprises loops designed to receive separate decorative elements, including beads, trinkets, semi-precious and precious gemstones.

5. The apparatus for the distribution and display of jewelry of claim 3 wherein the central member comprises loops designed to receive separate decorative elements, including beads, trinkets, semi-precious and precious gemstones.

6. The apparatus for the distribution and display of jewelry of claim 1 wherein said clothing piece comprises a material selected from the group consisting of fabric, leather, metal, rubber or plastic.

7. The apparatus for the distribution and display of jewelry of claim 1 wherein said clothing piece sidebars comprises a material selected from the group consisting of fabric, leather, metal, rubber or plastic.

8. The apparatus for the distribution and display of jewelry of claim 1 wherein said flexible strand member comprises a material selected from the group consisting of metal, rubber or plastic.

9. The apparatus for the distribution and display of jewelry of claim 1 wherein the clothing piece downbar member comprises a length to receive said jewelry piece downbar member above the tailbone of the wearer.

10. The apparatus for the distribution and display of jewelry of claim 1 wherein said flexible strand comprises decorative elements, including beads, trinkets, semi-precious and precious gems.

11. The apparatus for the distribution and display of jewelry of claim 1 wherein each of said attachment device of the jewelry piece comprises a jewelry clasp.

12. The apparatus for the distribution and display of jewelry of claim 1 wherein said jewelry piece downbar element attachment device comprising engagement and release of separate decorative elements, including beads, trinkets, semi-precious and precious gemstones.

13. The apparatus for the distribution and display of jewelry of claim 1 wherein the jewelry piece downbar element comprises a length to engage and release said clothing piece downbar member above the tailbone of the wearer.

14. An apparatus for the distribution and display of jewelry comprising in combination:

a. a generally planar clothing piece of a flexible textile or similar material with a frontpiece member with a top and bottom, said top wider than said bottom, with attached flexible textile or similar material first and second sidebar members, each sidebar member having first and second ends, said first and second sidebar members each attached at said first end to said frontpiece member, said attachment sites of first end configured so that the first and second sidebar members oppose each other from opposite sides of said top of said frontpiece member, said first and second sidebar members each with a semi-permanently attached loop of similar passive docking member at said second end, and an attached flexible textile or similar material downbar member with first and second ends, said first end attached and centered at the bottom of said frontpiece member, with a semi-permanently attached loop of similar passive docking member at said second end of said downbar member, each of said semi-permanently attached loops being configured to receive a respective attachment device;

c. a jewelry piece of a plurality of precious or semi-precious gems as well as beads and trinkets with a flexible strand having first and second ends, said first and second ends each having an attachment device, and one flexible downbar element with first and second ends, said first end attached to the flexible strand generally perpendicular to said flexible strand and said second end of said downbar element having an attachment device wherein all said attachment device of said jewelry piece are designed in order to engage and release loops or similar passive docking members of a second ends of said clothing piece or said flexible strand to form a wearable clothing piece or necklace, bracelet, or similar item to embrace and circumscribe a portion of human shape.

15. The apparatus for the distribution and display of jewelry of claim 14 wherein said jewelry piece downbar element first end comprises a visibly distinguishable attachment device to said flexible strand of said jewelry piece.

16. The apparatus for the distribution and display of jewelry of claim 15 wherein said visibly distinguishable attachment device comprises the incorporation of decorative elements visibly distinguishable from said flexible strand and downbar element.

17. The apparatus for the distribution and display of jewelry of claim 15 wherein the jewelry visibly distinguishable attachment device comprises loops designed to receive separate decorative elements, including beads, trinkets, semi-precious and precious gemstones.

18. The apparatus for the distribution and display of jewelry of claim 16 wherein the jewelry visibly distinguishable attachment device comprises loops designed to receive separate decorative elements, including beads, trinkets, semi-precious and precious gemstones.

19. The apparatus for the distribution and display of jewelry of claim 14 wherein the clothing piece downbar member comprises a length to receive said jewelry piece downbar element above the tailbone of the wearer.

20. The apparatus for the distribution and display of jewelry of claim 14 wherein said clothing piece comprises a material selected from the group consisting of fabric, leather, metal, rubber or plastic.

21. The apparatus for the distribution and display of jewelry of claim 14 wherein said clothing piece sidebars comprises a material selected from the group consisting of fabric, leather, metal, rubber or plastic.

22. The apparatus for the distribution and display of jewelry of claim 14 wherein said flexible strand member comprises a material selected from the group consisting of metal, rubber or plastic.

23. The apparatus for the distribution and display of jewelry of claim 14 wherein said flexible strand comprises decorative elements, including beads, trinkets, semi-precious and precious gems.

24. The apparatus for the distribution and display of jewelry of claim 13 wherein each of said attachment device of the jewelry piece comprises a jewelry clasp.

25. The apparatus for the distribution and display of jewelry of claim 13 wherein said jewelry piece downbar element attachment device comprising engagement and release of separate decorative elements, including beads, trinkets, semi-precious and precious gemstones.

26. The apparatus for the distribution and display of jewelry of claim 13 wherein the jewelry piece downbar element comprises a length to engage and release said clothing piece downbar member above the tailbone of the wearer.

27. The apparatus for the distribution and display of jewelry of claim 1 or 14 wherein said flexible strand has first and second ends, said first and second ends of the strand have loops or similar passive docking members, each of the loops or similar passive docking members being configured to receive a respective attachment device.

* * * * *